US005787995A

United States Patent [19]

Ekwall et al.

[11] Patent Number: 5,787,995

[45] Date of Patent: Aug. 4, 1998

[54] WATER DRIVEN HAMMER DEVICE

[75] Inventors: Berndt Ekwall, Saltsjöbaden; Gunnar Wijk, Enskede, both of Sweden

[73] Assignee: Atlas Copco Rock Drills AB, Orebro, Sweden

[21] Appl. No.: 860,072

[22] PCT Filed: Dec. 7, 1995

[86] PCT No.: PCT/SE95/01471

§ 371 Date: Jun. 16, 1997

§ 102(e) Date: Jun. 16, 1997

[87] PCT Pub. No.: WO96/19324

PCT Pub. Date: Jun. 27, 1996

[30] Foreign Application Priority Data

Dec. 21, 1994 [SE] Sweden ..... 9404429

[51] Int. Cl.[6] ..... B25D 9/04; E21B 4/14

[52] U.S. Cl. ..... 173/91; 173/17; 173/80; 173/112; 173/206; 173/212; 175/296

[58] Field of Search ..... 173/17, 91, 78, 173/80, 128, 206, 212, 112, 133, 59; 175/296

[56] References Cited

U.S. PATENT DOCUMENTS 1,768,633 7/1930 Ries .

4,068,727 1/1978 Andersson et al. ..... 173/212

4,871,035 10/1989 Ekwall ..... 173/212

5,038,874 8/1991 Larsson et al. ..... 173/80

5,107,944 4/1992 Gustafsson ..... 173/91

5,318,140 6/1994 Ekwall et al. ..... 173/80

5,385,209 1/1995 Bodell et al. ..... 173/78

5,488,998 2/1996 Ekwall et al. ..... 173/91

*Primary Examiner*—Scott A. Smith

*Attorney, Agent, or Firm*—Mark P. Stone

[57] ABSTRACT

A water driven hammer device has a machine housing and a hammer piston movable to-and-fro in the machine housing. The hammer piston is guided in the machine housing in two guides separated from each other. The guides are formed from two parts each having different inner diameters, and the parts with the largest inner diameters on the guide are turned towards each other. A room between the guides is pressurized and chambers on the other side of the guides are kept at a lower pressure, resulting in fluid flow through the guides for centering the hammer piston in the machine housing to avoid seizure of the hammer piston.

2 Claims, 1 Drawing Sheet

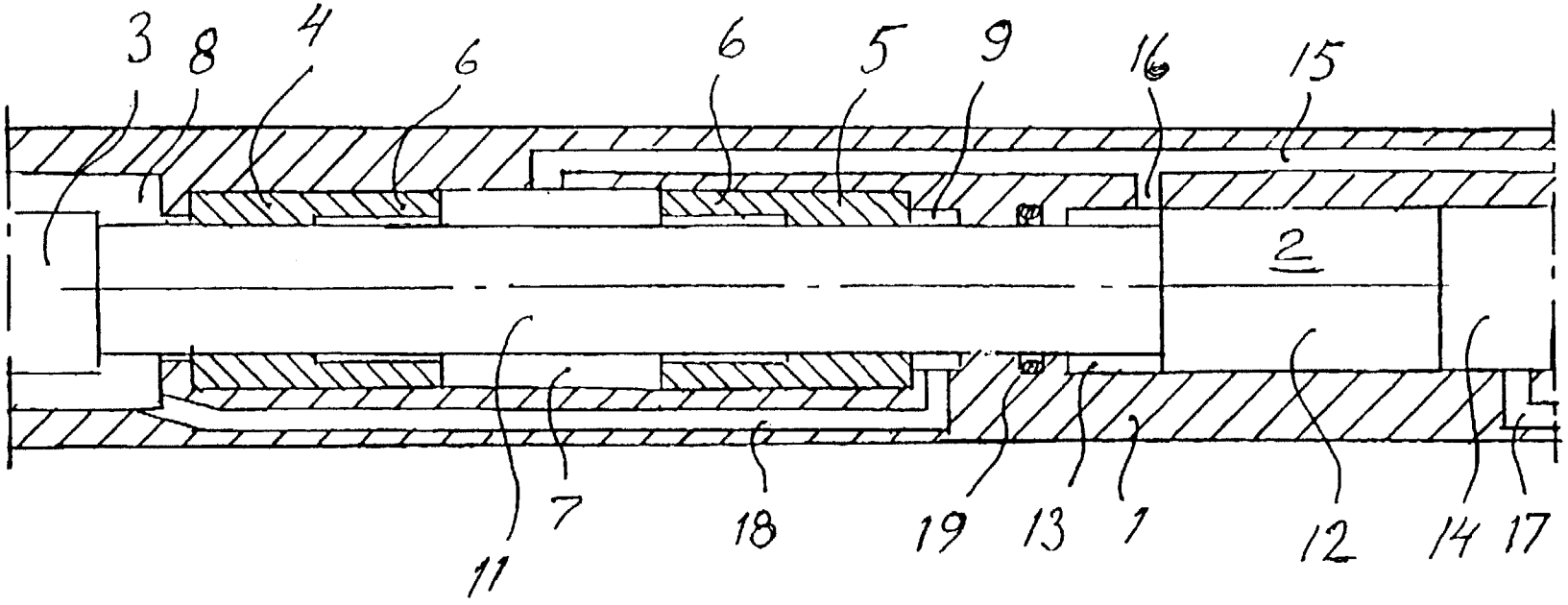
3
8
4
6
6
5
9
16
15
2
11
7
18
19
13
1
12
14
17

WATER DRIVEN HAMMER DEVICE

BACKGROUND OF THE INVENTION

The present invention relates to a water driven hammer device. More particularly the invention relates to the guiding of a hammer piston movable to-and-fro in the hammer device.

In previously known water driven hammer devices one has had problems with the service life because metallic contact between the hammer piston and the machine housing has resulted in the seizure of the hammer piston resulting in damages on the hammer piston and the machine housing.

SUMMARY OF THE INVENTION

The present invention, which is defined in the subsequent claims, aims at achieving a water driven hammer device with substantially increased service life. This is achieved by centering the hammer piston in the machine housing so that the driving head of the hammer piston does not come into metallic contact with the machine housing. The centering is achieved by means of a special design of the guides for the hammer piston in combination with the pressure conditions at the guides.

BRIEF DESCRIPTION OF THE DRAWINGS

An embodiment of the invention is described below with reference to the appended drawing which schematically shows a section through a part of a water driven hammer device according to the invention.

DESCRIPTION OF THE BEST MODES FOR CARRYING OUT THE INVENTION

The water driven hammer device shown in the drawing comprises a machine housing 1 in which a hammer piston 2 is movable to-and-fro. The hammer piston comprises a piston rod 11 and a piston head 12. The piston rod 11 is intended for impacting a tool 3 inserted into the machine housing 1. The hammer piston 2 is driven to-and-fro by alternately connecting room 14 to a source of high pressure water or to a low pressure via channel 17 in the usual way. Room 13 is via channels 15, 16 continuously pressurized in the shown example. It is also possible to supply room 13 with an alternating pressure in a known manner. The piston rod 11 of the hammer piston is guided in the machine housing 1 by two guides 4 and 5 which are arranged at a distance from each other in the machine housing 1. The shown guides are made with two parts of different inner diameter. The parts 6 with the largest inner diameter are turned towards each other. The room 7 between the guides is pressurized via the channel 15. The channel 15 may contain a not shown restriction in order to obtain a suitable level of the pressure in room 7. The chamber 8 is connected to a lower pressure than the pressure in room 7. The chamber 9 is via channel 18 connected to chamber 8. A seal 19 is arranged in the machine housing to separate chamber 9 from the room 13. In a practical example the distance between the two guides is about 300 mm and the play between the piston rod 11 and the guides 4 and 5 of the order of 0.02–0.03 mm. The play at the larger diameter is about the double or somewhat less. This design of the guides in combination with the pressure in room 7 and the lower pressure in chambers 8, 9 gives a pressure and a flow between the piston rod 11 and guides 4, 5 which causes a precise centering of the hammer piston 2 in the guides. Through this it is avoided that the piston head 12 of the hammer piston comes into contact with the machine housing 1 in spite of the play between the piston head and the machine housing being small to avoid unnecessary leakage across the piston head.

The guides have in the shown example two parts with different diameters. They can also be made with several steps or for instance be conical or have another form as long as a centering pressure and flow is achieved in the slot between the piston rod and the guide.

As an alternative to what has been described above one can turn the guides 4 and 5 and pressurize the chambers outside the guides and keep the room between the guides at a lower pressure, whereby the flow through the slots between the guides and the hammer piston is directed in the opposite direction.

The hammer device shown is a down the hole drilling machine. The invention can also be used in top hammers.

We claim:

1. Water driven hammer device comprising a machine housing (1), a hammer piston (2) movable to-and-fro in the machine housing for impacting a tool (3) inserted into the machine housing and two guides (4, 5) arranged at a distance from each other in the machine housing (1) for guiding the movement of the hammer piston, characterized in that said guides (4, 5) comprise at least two parts with different inner diameters, that the part (6) with the largest inner diameter on each guide (4, 5) is positioned closest to the other guide, and that a room (7) between the two guides (4, 5) is maintained at a pressure higher than the pressure in a chamber (8, 9) on an opposite side of each guide (4, 5).

2. Water driven hammer device comprising a machine housing (1), a hammer piston (2) movable to-and-fro in the machine housing for impacting a tool (3) inserted into the machine housing and two guides (4, 5) arranged at a distance from each other in the machine housing (1) for guiding the movement of the hammer piston, characterized in that said guides (4, 5) comprise at least two parts with different inner diameters, that the part (6) with the largest inner diameter on each guide is positioned furthest away from the other guide, and that a room between the two guides is maintained at a pressure less than the pressure in a chamber on an opposite side of each guide.

* * * * *